US010818217B1

(12) United States Patent
Hsiang et al.

(10) Patent No.: US 10,818,217 B1
(45) Date of Patent: Oct. 27, 2020

(54) SELF-ILLUMINATING DISPLAY APPARATUS AND DISPLAY FRAME COMPENSATION METHOD THEREOF

(71) Applicant: Acer Incorporated, New Taipei (TW)

(72) Inventors: Jui-Chieh Hsiang, New Taipei (TW); Chih-Chiang Chen, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/708,331

(22) Filed: Dec. 9, 2019

(30) Foreign Application Priority Data

Aug. 7, 2019 (TW) ..... 108128057 A

(51) Int. Cl.
*G09G 3/30* (2006.01)
*G09G 3/20* (2006.01)

(52) U.S. Cl.
CPC ..... *G09G 3/2007* (2013.01); *G09G 2310/027* (2013.01); *G09G 2320/0233* (2013.01); *G09G 2320/0276* (2013.01); *G09G 2320/0285* (2013.01); *G09G 2320/0626* (2013.01); *G09G 2330/023* (2013.01); *G09G 2330/026* (2013.01);

(Continued)

(58) Field of Classification Search
CPC .. G09G 3/36; G09G 3/34; G09G 3/32; G09G 5/00; G09G 3/30; G11C 19/00; G02F 1/1345; G06F 3/038
See application file for complete search history.

(56) References Cited

U.S. PATENT DOCUMENTS

2013/0044146 A1* 2/2013 Kurokawa ..... G09G 3/3611 345/690
2016/0307490 A1* 10/2016 Lee ..... G09G 3/2022

(Continued)

FOREIGN PATENT DOCUMENTS

| | | |
|---|---|---|
| CN | 201185077 | 1/2009 |
| CN | 103730090 | 10/2015 |
| CN | 105096829 | 6/2017 |

OTHER PUBLICATIONS

Jun-Suk Bang, et al., "A Real-time TFT Compensation through Power Line Current Sensing for High-resolution AMOLED Displays." SID Symposium Digest of Technical Papers, vol. 45, No. 1, Jul. 7, 2014, pp. 724-727.

*Primary Examiner* — Pegeman Karimi
(74) *Attorney, Agent, or Firm* — JCIPRNET

(57) ABSTRACT

A self-illuminating display apparatus and a display frame compensation method thereof are provided. The self-illuminating display apparatus includes pixel units, a display driving circuit, and a compensation estimation circuit. The compensation estimation circuit converts a gray-level data matrix into an original data voltage matrix, and accumulates the received gray-level data matrix over time to obtain a cumulative gray-level matrix. The compensation estimation circuit determines a degree of luminance attenuation of the pixel units based on the cumulative gray-level matrix. The compensation estimation circuit generates a compensation voltage matrix according to the gray-level data matrix and the degree of luminance attenuation of the pixel units. The compensation estimation circuit generates a compensated data voltage matrix according to the original data voltage matrix and the compensation voltage matrix. The pixel units are driven by the display driving circuit according to the compensated data voltage matrix.

14 Claims, 9 Drawing Sheets

(52) U.S. Cl.
CPC ... *G09G 2330/027* (2013.01); *G09G 2360/16* (2013.01)

(56) References Cited

U.S. PATENT DOCUMENTS

2017/0287418 A1* 10/2017 Hwang ..... G09G 3/3614
2020/0013346 A1* 1/2020 Hong ..... G09G 3/342

* cited by examiner

SELF-ILLUMINATING DISPLAY APPARATUS AND DISPLAY FRAME COMPENSATION METHOD THEREOF

CROSS-REFERENCE TO RELATED APPLICATION

This application claims the priority benefit of Taiwan application serial no. 108128057, filed on Aug. 7, 2019. The entirety of the above-mentioned patent application is hereby incorporated by reference herein and made a part of this specification.

BACKGROUND

Technical Field

The disclosure relates to a display technology, and in particular, to a self-illuminating display apparatus and a display frame compensation method thereof.

Description of Related Art

With the development of the semiconductor industry and the optoelectronic industry, a light emission diode (LED) is widely used in lighting applications as well as in the field of displays. A self-illuminating display such as an organic-LED (OLED) display, a micro LED display, and a quantum dot AMOLED display is considered to be one of the mainstream displays in the future because of the characteristics of high luminance, high contrast, wide viewing angle, and the like.

However, based on the pixel material characteristics of the self-illuminating display and the temperature change of the self-illuminating display after long-term operation, the amount of current flowing through the LED of the self-illuminating display is incorrect, resulting in the problems of luminance error and image sticking in the self-illuminating display.

SUMMARY

In view of this, the disclosure provides a self-illuminating display apparatus and a display frame compensation method thereof, which can improve the luminance accuracy of a display frame.

The self-illuminating display apparatus of the disclosure includes a pixel array, a display driving circuit, and a compensation estimation circuit. The pixel array has a plurality of pixel units arranged in an array. The display driving circuit is coupled to the pixel array, and configured to receive a compensated data voltage matrix and drive the pixel units according to the compensated data voltage matrix. The compensation estimation circuit is coupled to the display driving circuit. The compensation estimation circuit receives a gray-level data matrix, and converts the gray-level data matrix into an original data voltage matrix. The compensation estimation circuit accumulates the received gray-level data matrix over time to obtain a cumulative gray-level matrix corresponding to the pixel units, determines a degree of luminance attenuation of the pixel units based on the cumulative gray-level matrix, generates a first compensation voltage matrix according to the gray-level data matrix and the degree of luminance attenuation of the pixel units, and generates the compensated data voltage matrix according to the original data voltage matrix and the first compensation voltage matrix.

The display frame compensation method of the disclosure is used for a self-illuminating display apparatus. The self-illuminating display apparatus includes pixel units arranged in an array, a display driving circuit, and a compensation estimation circuit. The display frame compensation method includes the following steps. The compensation estimation circuit converts a gray-level data matrix into an original data voltage matrix, and accumulates the received gray-level data matrix over time to obtain a cumulative gray-level matrix corresponding to the pixel units. The compensation estimation circuit determines a degree of luminance attenuation of the pixel units based on the cumulative gray-level matrix. The compensation estimation circuit generates a first compensation voltage matrix according to the gray-level data matrix and the degree of luminance attenuation of the pixel units. The compensation estimation circuit generates a compensated data voltage matrix according to the original data voltage matrix and the first compensation voltage matrix. The display driving circuit drives the pixel units according to the compensated data voltage matrix.

Based on the above, in the self-illuminating display apparatus and the display frame compensation method thereof provided by the disclosure, the compensation estimation circuit may determine the degree of luminance attenuation of the pixel units based on the cumulative gray-level matrix, and accordingly provide the compensated data voltage matrix. The display driving circuit may drive the pixel units according to the compensated data voltage matrix, so that the pixel units display the correct luminance, thereby reducing the influence of the material characteristics of the pixel units on the display luminance of the pixel units.

In order to make the aforementioned and other objectives and advantages of the disclosure comprehensible, embodiments accompanied with figures are described in detail below.

DESCRIPTION OF THE EMBODIMENTS

Figure 1:
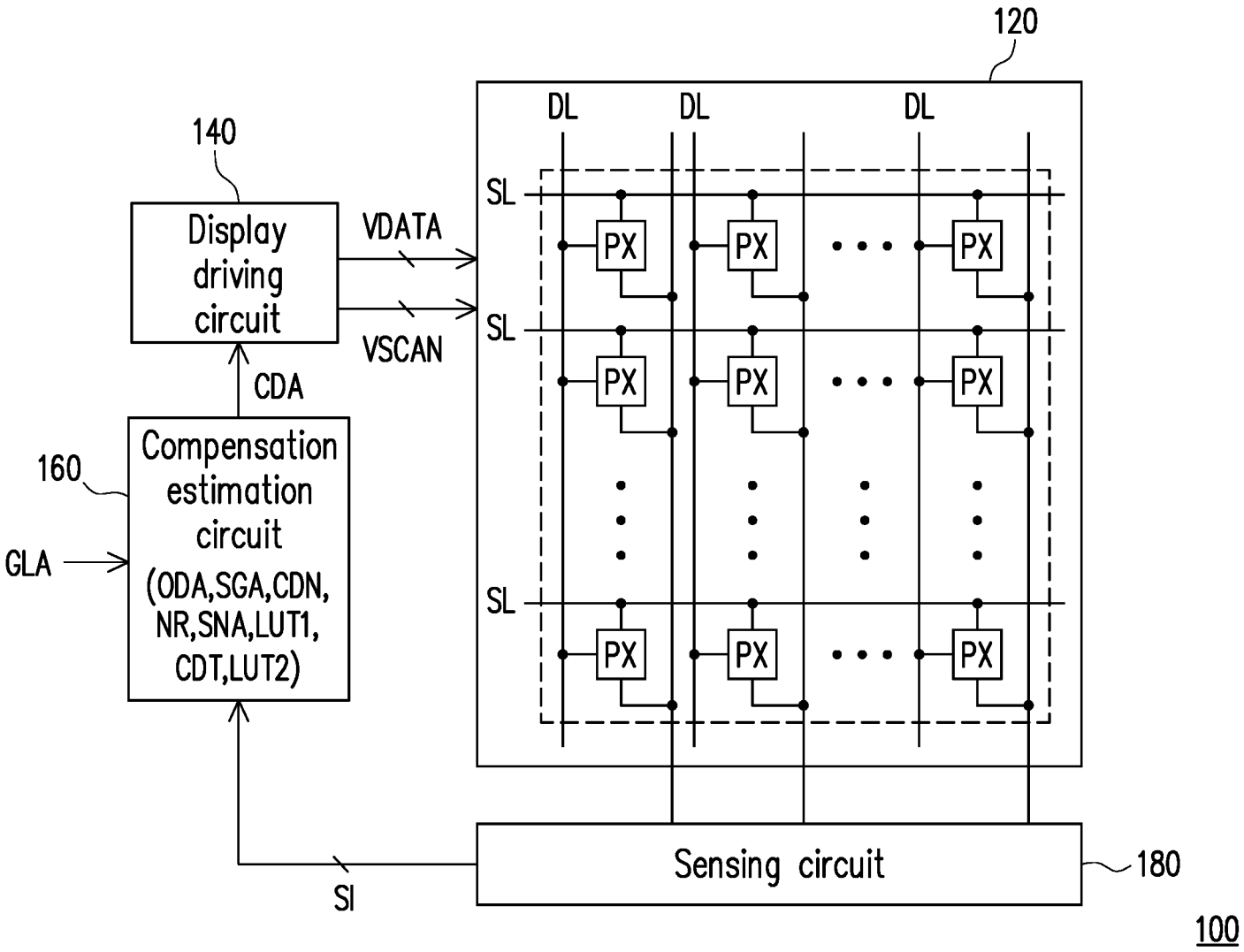
FIG. 1 is a block diagram of a self-illuminating display apparatus in accordance with an embodiment of the disclosure.

In order to make the content of the disclosure more comprehensible, embodiments are described below as examples of implementation of the disclosure. Wherever possible, the same reference numbers are used in the drawings and the description to refer to the same or like parts, components or steps.

FIG. 1 is a block diagram of a self-illuminating display apparatus in accordance with an embodiment of the disclosure. Referring to FIG. 1, a self-illuminating display apparatus 100 may include a pixel array 120, a display driving circuit 140, and a compensation estimation circuit 160. However, the disclosure is not limited thereto.

The pixel array 120 has a plurality of pixel units PX arranged in an array. The pixel unit PX may be, for example, a self-illuminating unit such as an OLED pixel unit, a micro LED pixel unit, or a quantum dot AMOLED pixel unit. However, the disclosure is not limited thereto. In addition, the pixel array 120 further includes a plurality of scan lines SL and a plurality of data lines DL. The pixel units PX are electrically connected to the corresponding scan lines SL and the corresponding data lines DL, respectively.

The compensation estimation circuit 160 is coupled to the display driving circuit 140. The compensation estimation circuit 160 is configured to receive a gray-level data matrix GLA. The gray-level data matrix GLA includes a plurality of original gray-level data corresponding to the pixel units PX. The compensation estimation circuit 160 may convert the gray-level data matrix GLA into an original data voltage matrix ODA. The original data voltage matrix ODA includes a plurality of original data voltages corresponding to the pixel units PX.

In particular, the compensation estimation circuit 160 may accumulate the received gray-level data matrix GLA over time to obtain a cumulative gray-level matrix SGA. The cumulative gray-level matrix SGA includes a plurality of cumulative gray-level values corresponding to the pixel units PX. The compensation estimation circuit 160 may determine a degree of luminance attenuation of the pixel units PX based on the cumulative gray-level matrix SGA, and generate a first compensation voltage matrix CDN according to the gray-level data matrix GLA and the degree of luminance attenuation of the pixel units PX. The first compensation voltage matrix CDN includes a plurality of first compensation voltages corresponding to the pixel units PX. The compensation estimation circuit 160 may generate a compensated data voltage matrix CDA according to the original data voltage matrix ODA and the first compensation voltage matrix CDN. The compensated data voltage matrix CDA includes a plurality of compensated data driving voltages VDATA, and the compensated data driving voltages VDATA correspond to the pixel units PX respectively.

In an embodiment of the disclosure, the compensated data voltage matrix CDA is a sum of the original data voltage matrix ODA and the first compensation voltage matrix CDN.

In an embodiment of the disclosure, the compensation estimation circuit 160 may be implemented by using a processor or a micro control unit. However, the disclosure is not limited thereto.

The display driving circuit 140 is coupled to the compensation estimation circuit 160 to receive the compensated data voltage matrix CDA, and is coupled to the scan lines SL and the data lines DL of the pixel array 120. The display driving circuit 140 may sequentially generate scan driving voltages VSCAN to the scan lines SL, and may output the compensated data driving voltages VDATA to the data lines DL, so as to drive the pixel units PX to emit light and improve the luminance accuracy of the pixel units PX.

In an embodiment of the disclosure, the display driving circuit 140 may include a timing control circuit, a data line driving circuit, and a scan line driving circuit. However, the disclosure is not limited thereto. The timing control circuit, the data line driving circuit and the scan line driving circuit may be implemented by using an existing timing control circuit, data line driving circuit and scan line driving circuit, respectively. The implementation details and related operations thereof are well known to those skilled in the art. Therefore, the descriptions are omitted herein.

In an embodiment of the disclosure, the compensation estimation circuit 160 may convert the cumulative gray-level matrix SGA into a cumulative count matrix SNA according to a conversion parameter NR. The cumulative count matrix SNA includes a plurality of cumulative count values corresponding to the pixel units PX. The compensation estimation circuit 160 may determine a degree of luminance attenuation of the pixel units PX according to the cumulative count matrix SNA. The conversion parameter NR is associated with material characteristics of the pixel units PX.

Figure 2A:
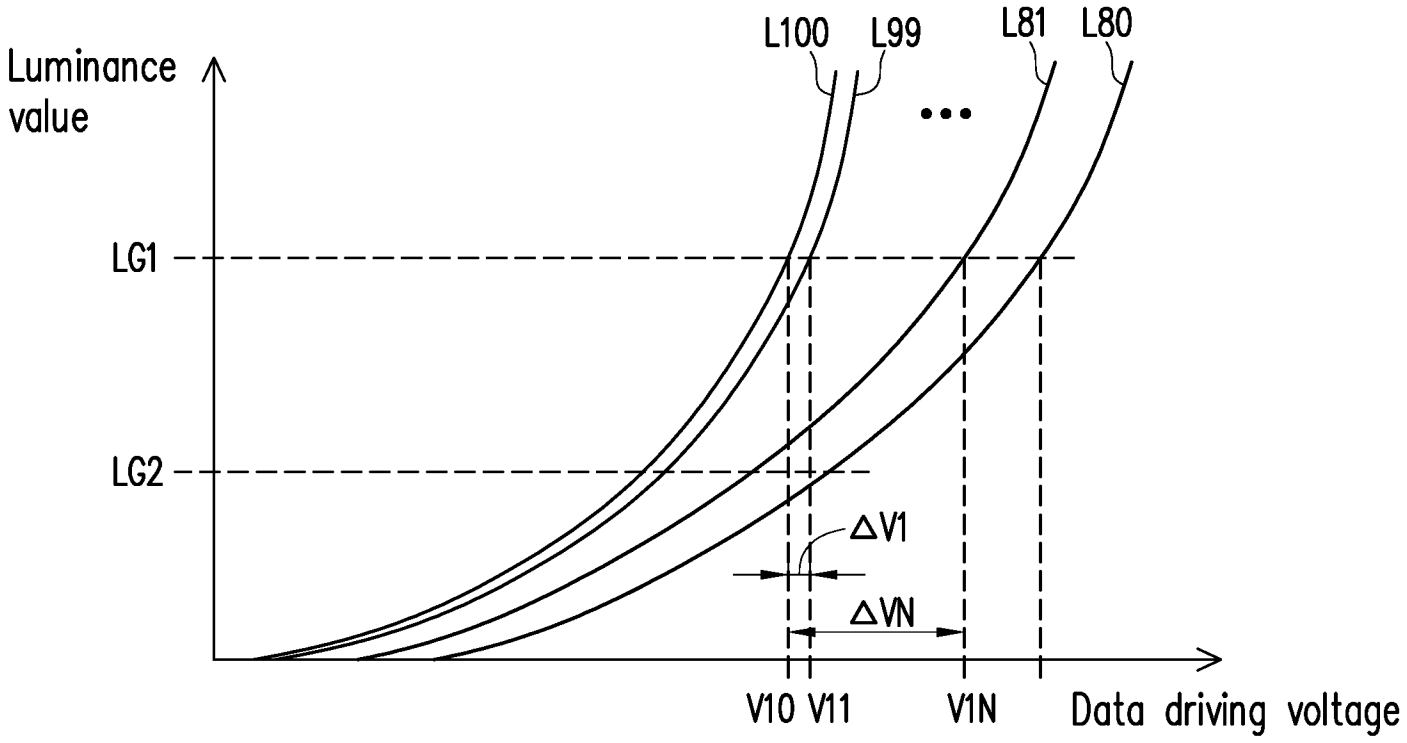
FIG. 2A is a schematic diagram showing a relation curve between a data driving voltage, a luminance value of a pixel unit, and a degree of luminance attenuation of a pixel unit in accordance with an embodiment of the disclosure.

In detail, based on the material characteristics of the pixel unit PX, in the case where the data driving voltage of the pixel unit PX remains unchanged, the luminance of the pixel unit PX will attenuate along with the increase of the cumulative gray-level value (or cumulative count value) of the pixel unit PX. Therefore, a designer may perform a luminance test on the pixel array 120 according to different data driving voltages to obtain a relation curve between the data driving voltage, the luminance value of the pixel unit PX and the degree of luminance attenuation of the pixel unit PX as shown in FIG. 2A. A curve L100 is a luminance curve in which the luminance of the pixel unit PX does not attenuate (i.e., original luminance). A curve L99 is a luminance curve in which the luminance of the pixel unit PX is 99% of the original luminance. A curve L81 is a luminance curve in which the luminance of the pixel unit PX is 81% of the original luminance. A curve L80 is a luminance curve in which the luminance of the pixel unit PX is 80% of the original luminance.

As can be seen from FIG. 2A, as the degree of luminance attenuation of the pixel unit PX is larger, if the luminance of the pixel unit PX is to be maintained at a specific luminance value LG1 (or LG2), the provided data driving voltage is also increased. For example, in the case where the luminance of the pixel unit PX is 99% of the original luminance, if the luminance of the pixel unit PX is to be set to the luminance value LG1, the data driving voltage must be increased from a voltage value V10 corresponding to the original luminance to a voltage value V11. A voltage difference ΔV1 between the voltage values V11 and V10 is a first compensation voltage corresponding to the luminance value LG1 in the case where the luminance of the pixel unit PX is 99% of the original luminance. Similarly, in the case where the luminance of the pixel unit PX is 81% of the original luminance, if the luminance of the pixel unit PX is to be set to the luminance value LG1, the data driving voltage must be increased from the voltage value V10 corresponding to the original luminance to a voltage value V1N. A voltage difference ΔVN between the voltage values V1N and V10 is the first compensation voltage corresponding to the luminance value LG1 in the case where the luminance of the pixel unit PX is 81% of the original luminance.

Figure 2B:
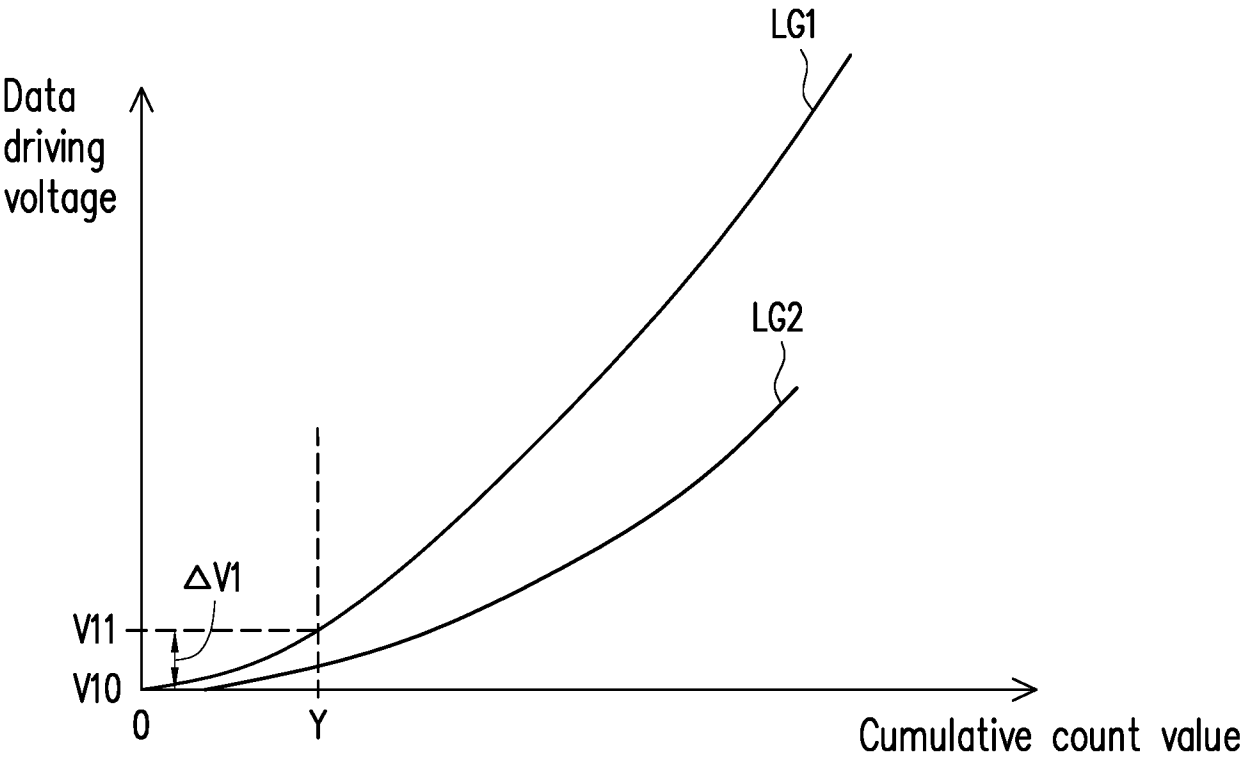
FIG. 2B is a schematic diagram showing a relation curve between a data driving voltage, a luminance value of a pixel unit, and a cumulative count value of a pixel unit in accordance with an embodiment of the disclosure.

In addition, the designer may also set the conversion parameter NR according to the material characteristics of the pixel unit PX, and may obtain a correspondence between the degree of luminance attenuation of the pixel unit PX and the cumulative count value of the pixel unit PX according to the material characteristics of the pixel unit PX. Therefore, the designer may convert the relation curve shown in FIG. 2A into a relation curve between the data driving voltage, the luminance value of the pixel unit PX and the cumulative count value of the pixel unit PX as shown in FIG. 2B according to the conversion parameter NR and the correspondence between the degree of luminance attenuation of the pixel unit PX and the cumulative count value of the pixel unit PX. In this way, the designer may establish a lookup table LUT1 according to the relation curve shown in FIG. 2A or FIG. 2B.

In an embodiment of the disclosure, the compensation estimation circuit 160 may find the first compensation voltages corresponding to the pixel units PX in the lookup table LUT1 according to the gray-level data matrix GLA and the cumulative count matrix SNA respectively.

For example, it is supposed that the conversion parameter NR is 5 (that is, one cumulative count corresponds to every accumulation of five gray-level values). The original gray-level data of the pixel unit PX in a first frame and a second frame are 15 gray-level and 30 gray-level, respectively. Therefore, the cumulative gray-level value of the pixel unit PX in the two frames is 45 gray-level, and the cumulative count value of the pixel unit PX in the two frames is 9.

In addition, it is supposed that when the cumulative count value reaches Y, the luminance of the pixel unit PX attenuates to 99% of the original luminance. If the cumulative count value of the pixel unit PX in a current frame has reached Y and an original data voltage converted from original gray-level data of the pixel unit PX in the current frame is V10, the compensation estimation circuit 160 may know that an original luminance value corresponding to the original data voltage (V10) is LG1 according to the curve L100 of FIG. 2A, and the compensation estimation circuit 160 may obtain a first compensation voltage ΔV1 in the relation curve (or the corresponding lookup table LUT1) shown in FIG. 2B according to the luminance value (LG1) and the cumulative count value (Y). In addition, the compensation estimation circuit 160 may add the original data voltage (i.e., V10) to the first compensation voltage (i.e., ΔV1) to obtain a compensated data driving voltage (i.e., V11), and the display driving circuit 140 may drive the pixel unit PX according to the compensated data driving voltage (i.e., V11), so that the pixel unit PX may display a correct luminance value (i.e., LG1), thereby reducing the influence of the material characteristics of the pixel unit PX on the display luminance of the pixel unit PX.

In an embodiment of the disclosure, the compensation estimation circuit 160 may also download data from a cloud database to update the lookup table LUT1, depending on actual application or design requirements.

Figure 3:
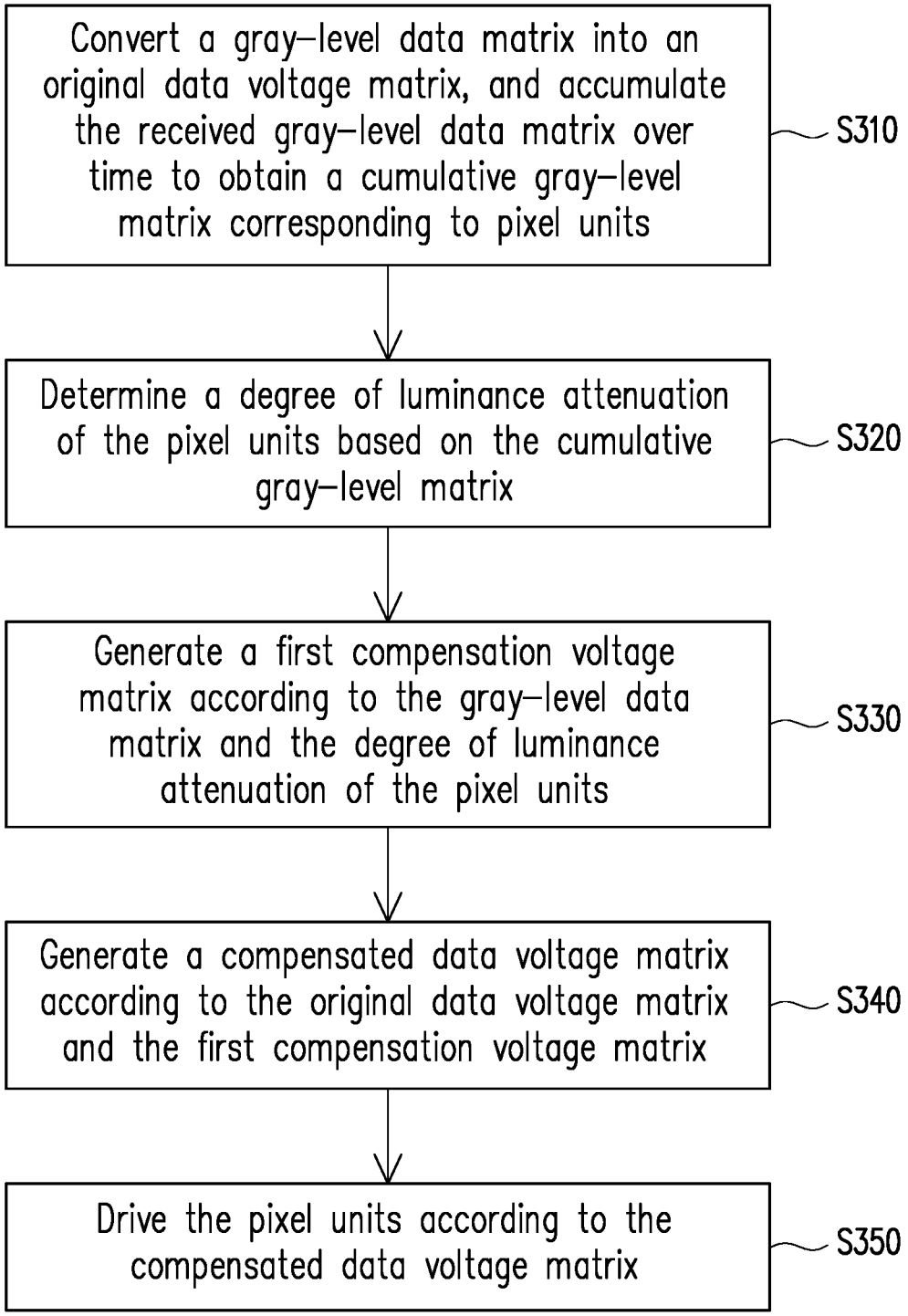
FIG. 3 is a flowchart showing the steps of a display frame compensation method in accordance with an embodiment of the disclosure.

FIG. 3 is a flowchart showing the steps of a display frame compensation method in accordance with an embodiment of the disclosure. The method may be suitable for the self-illuminating display apparatus 100 of FIG. 1, but is not limited thereto. Referring to FIG. 1 and FIG. 3 together, the display frame compensation method of the exemplary embodiment includes the following steps. First, in step S310, a compensation estimation circuit 160 converts a gray-level data matrix GLA into an original data voltage matrix ODA, and accumulates the received gray-level data matrix GLA over time to obtain a cumulative gray-level matrix SGA corresponding to pixel units PX. Next, in step S320, the compensation estimation circuit 160 determines a degree of luminance attenuation of the pixel units PX based on the cumulative gray-level matrix SGA. Thereafter, in step S330, the compensation estimation circuit 160 generates a first compensation voltage matrix CDN according to the gray-level data matrix GLA and the degree of luminance attenuation of the pixel units PX. Next, in step S340, the compensation estimation circuit 160 generates a compensated data voltage matrix CDA according to the original data voltage matrix ODA and the first compensation voltage matrix CDN. Then, in step S350, a display driving circuit 140 drives the pixel units PX according to the compensated data voltage matrix CDA.

In addition, other details of the display frame compensation method of the embodiment of FIG. 3 of the disclosure may be sufficiently illustrated, suggested, and implemented by the description of the embodiments of FIG. 1 to FIG. 2B, and therefore the descriptions thereof are omitted.

Please refer back to FIG. 1. In an embodiment of the disclosure, after the self-illuminating display apparatus 100 is powered on, the compensation estimation circuit 160 may further calculate operation time of the self-illuminating display apparatus 100. The compensation estimation circuit 160 may generate a second compensation voltage matrix CDT according to the gray-level data matrix GLA and the operation time of the self-illuminating display apparatus 100. The second compensation voltage matrix CDT includes a plurality of second compensation voltages corresponding to the pixel units PX. The compensation estimation circuit 160 generates the compensated data voltage matrix CDA according to the original data voltage matrix ODA, the first compensation voltage matrix CDN and the second compensation voltage matrix CDT. In this way, not only the influence of the material characteristics of the pixel unit PX on the display luminance of the pixel unit PX can be reduced, but also the influence of temperature rise after long-term operation on the display luminance of the pixel unit PX can be effectively reduced.

In an embodiment of the disclosure, the compensated data voltage matrix CDA is a sum of the original data voltage matrix ODA, the first compensation voltage matrix CDN and the second compensation voltage matrix CDT.

In an embodiment of the disclosure, the compensation estimation circuit 160 may find the second compensation voltages corresponding to the pixel units PX in a power-on-off curve lookup table LUT2 according to the gray-level data matrix GLA and the operation time of the self-illuminating display apparatus 100. The following describes how the power-on-off curve lookup table LUT2 is established.

In detail, as shown in FIG. 1, the self-illuminating display apparatus 100 may further include a sensing circuit 180. The sensing circuit 180 is coupled to the pixel array 120 and the compensation estimation circuit 160. The sensing circuit 180 is configured to sense a current of each of the pixel units PX and accordingly generate a plurality of sensing current values corresponding to the pixel units PX respectively. In an embodiment of the disclosure, the sensing circuit 180 may be implemented by using an existing current sensor, but is not limited thereto.

When the self-illuminating display apparatus 100 is activated to perform a power-on operation, the compensation estimation circuit 160 may provide a data driving voltage through the display driving circuit 140 to drive the pixel units PX. The compensation estimation circuit 160 may obtain sensing current values SI during power-on through the sensing circuit 180. The compensation estimation circuit 160 may establish a first current-voltage relation curve TL_ON as shown in FIG. 4A according to the data driving voltage and the sensing current values SI during power-on.

In addition, when the self-illuminating display apparatus 100 is powered off to perform a power-off operation, the compensation estimation circuit 160 may provide the data driving voltage through the display driving circuit 140 to drive the pixel units PX. The compensation estimation circuit 160 may obtain sensing current values SI during power-off through the sensing circuit 180. The compensation estimation circuit 160 may establish a second current-voltage relation curve TL_OFF as shown in FIG. 4A according to the data driving voltage and the sensing current values SI during power-off. The compensation estimation circuit 160 may establish the power-on-off curve lookup table LUT2 according to the first current-voltage relation curve TL_ON and the second current-voltage relation curve TL_OFF.

Figure 4A:
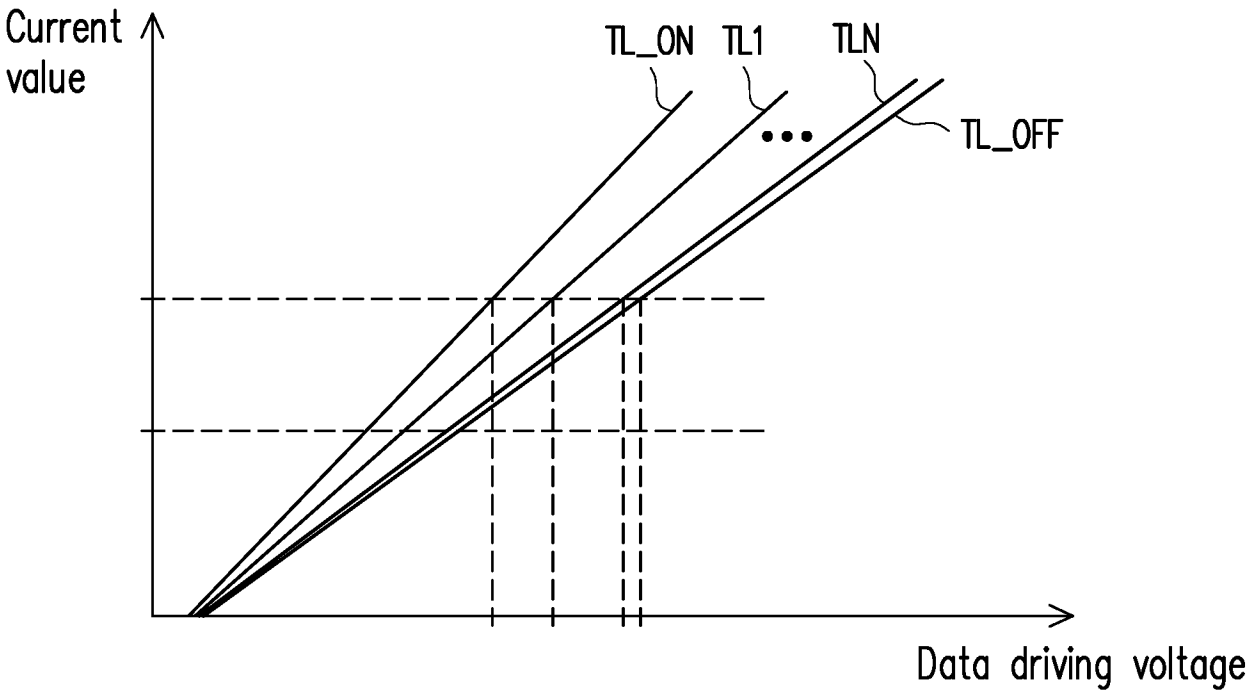
FIG. 4A is a schematic diagram showing a relation curve between a current value of a pixel unit, operation time of a self-illuminating display apparatus, and a data driving voltage in accordance with an embodiment of the disclosure.

Please refer to FIG. 1 and FIG. 4A together. In an embodiment of the disclosure, the compensation estimation circuit 160 may obtain current-voltage relation curves TL1-TLN of the self-illuminating display apparatus 100 at other operation time by an interpolation method according to the first current-voltage relation curve TL_ON and the second current-voltage relation curve TL_OFF. The current-voltage relation curves TL1-TLN are current-voltage relation curves of operation time T1-TN, respectively. The compensation estimation circuit 160 may establish the power-on-off curve lookup table LUT2 according to the first current-voltage relation curve TL_ON, the second current-voltage relation curve TL_OFF and the current-voltage relation curves TL1-TLN of other operation time. However, the disclosure is not limited thereto. In another embodiment of the disclosure, the current-voltage relation curves TL1-TLN of the self-illuminating display apparatus 100 at other operation time may also be provided by a manufacturer of the pixel array 120.

In an embodiment of the disclosure, the second current-voltage relation curve TL_OFF may be established, for example, by the compensation estimation circuit 160 during the previous power-off operation, and the first current-voltage relation curve TL_ON may be established, for example, by the compensation estimation circuit 160 during a current power-on operation (i.e., the present power-on operation). Therefore, the compensation estimation circuit 160 establishes the power-on-off curve lookup table LUT2 according to the first current-voltage relation curve TL_ON obtained by the current power-on operation and the second current-voltage relation curve TL_OFF obtained by a previous power-off operation.

Figure 4B:
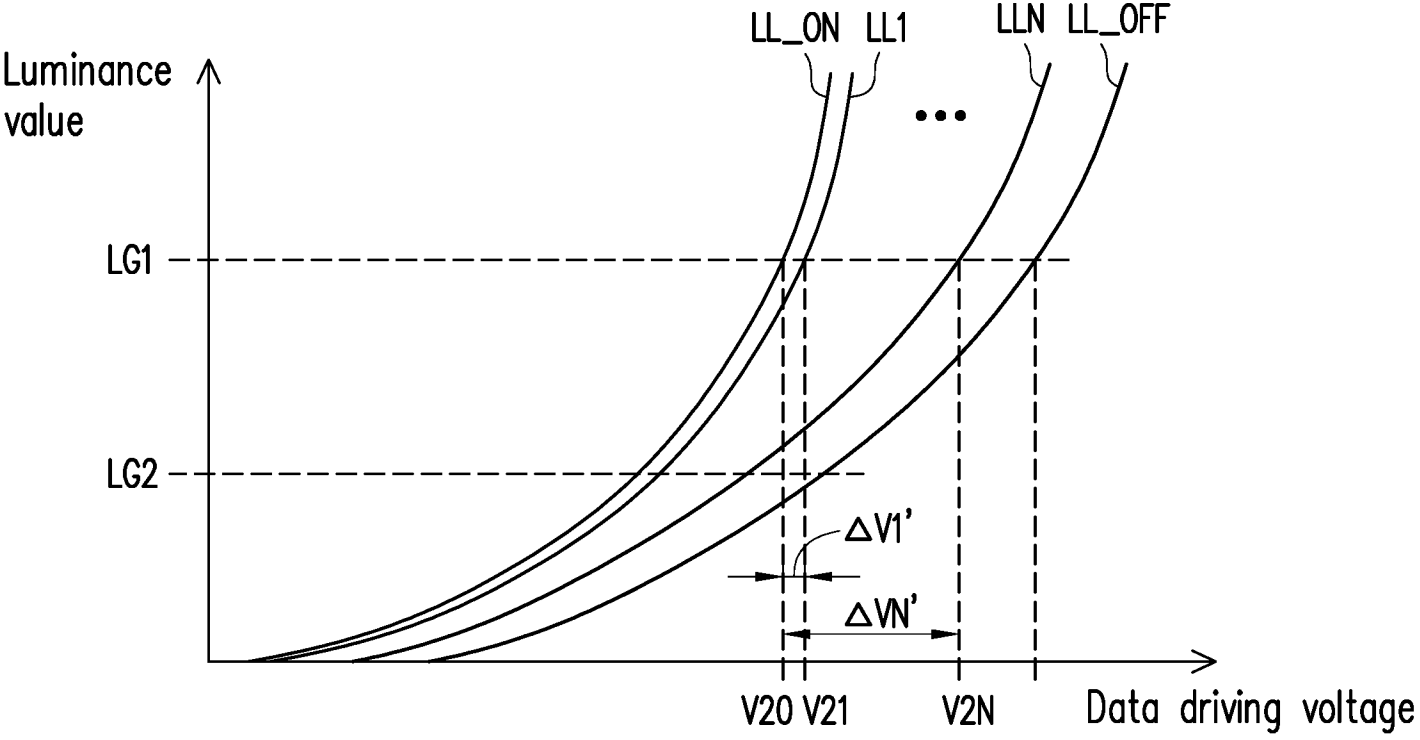
FIG. 4B is a schematic diagram showing a relation curve between a luminance value of a pixel unit, operation time of a self-illuminating display apparatus, and a data driving voltage in accordance with an embodiment of the disclosure.

In an embodiment of the disclosure, the compensation estimation circuit 160 may convert the current-voltage relation curves TL_ON, TL1-TLTL and TL_OFF as shown in FIG. 4A into relation curves LL_ON, LL1-LLN and LL_OFF as shown in FIG. 4B, respectively. The relation curves LL_ON, LL1-LLN and LL_OFF are luminance-to-voltage relation curves during power-on, at operation time T1-TN and during power-off, respectively.

Figure 4C:
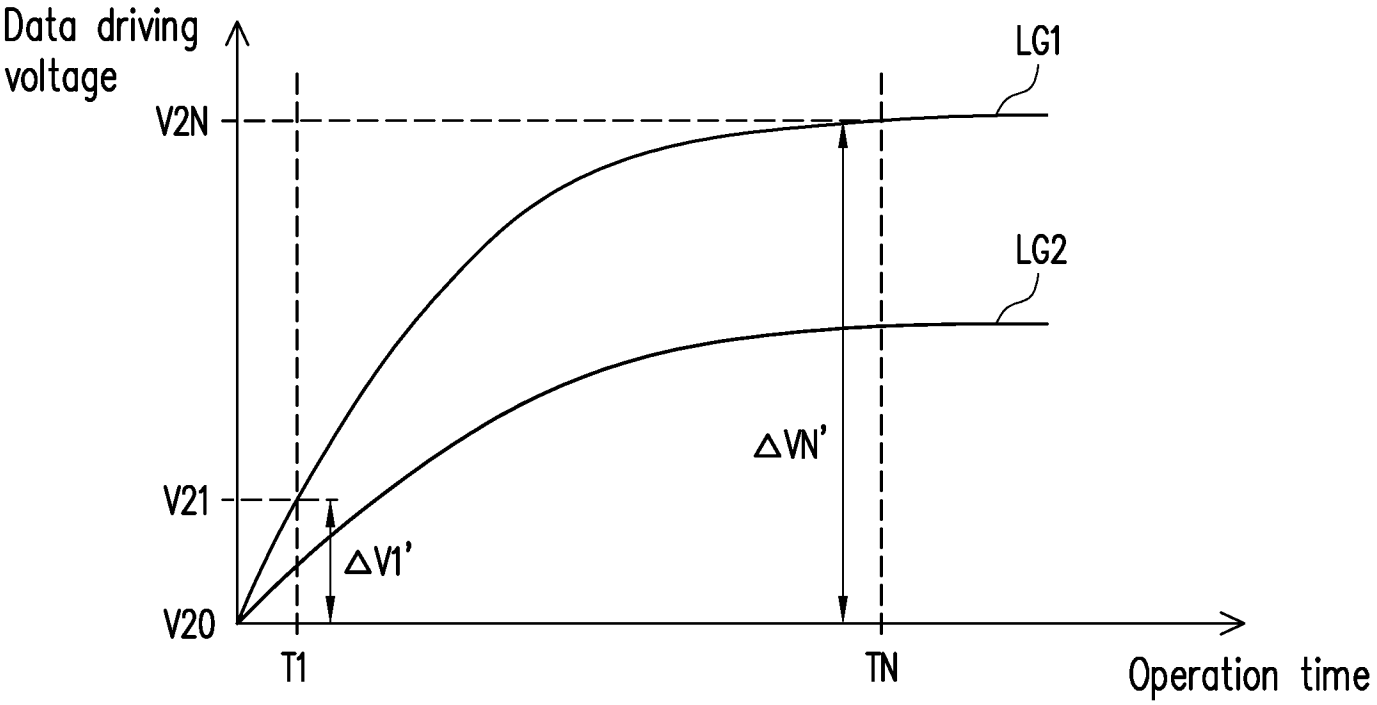
FIG. 4C is a schematic diagram showing a relation curve between a data driving voltage, a luminance value of a pixel unit, and operation time of a self-illuminating display apparatus in accordance with an embodiment of the disclosure.

In an embodiment of the disclosure, the compensation estimation circuit 160 may also convert the relation curve shown in FIG. 4B into a relation curve between the data driving voltage, the luminance value of the pixel unit PX and the operation time as shown in FIG. 4C. The power-on-off curve lookup table LUT2 is established according to the relation curve shown in FIG. 4C.

As can be seen from FIG. 4A to FIG. 4C, in the case where the data driving voltage of the pixel unit PX remains unchanged, the current value of the pixel unit PX decreases as the operation time of the self-illuminating display apparatus 100 increases, resulting in luminance decrease of the pixel unit PX as the operation time of the self-illuminating display apparatus 100 increases. For example, when the operation time of the self-illuminating display apparatus 100 is T1, if the luminance of the pixel unit PX is to be set to the luminance value LG1, the data driving voltage must be improved from a voltage value V20 during power-on to a voltage value V21. A voltage difference ΔV1' between the voltage values V21 and V20 is the second compensation voltage corresponding to the luminance value LG1 in the case where the operation time is T1. Similarly, when the operation time of the self-illuminating display apparatus 100 is TN, if the luminance of the pixel unit PX is to be set to the luminance value LG1, the data driving voltage must be improved from the voltage value V20 during power-on to a voltage value V2N. A voltage difference ΔVN' between the voltage values V2N and V20 is the second compensation voltage corresponding to the luminance value LG1 in the case where the operation time is TN.

In an embodiment of the disclosure, the compensation estimation circuit 160 may also download data from a cloud database to update the power-on-off curve lookup table LUT2, depending on actual application or design requirements.

Figure 5A:
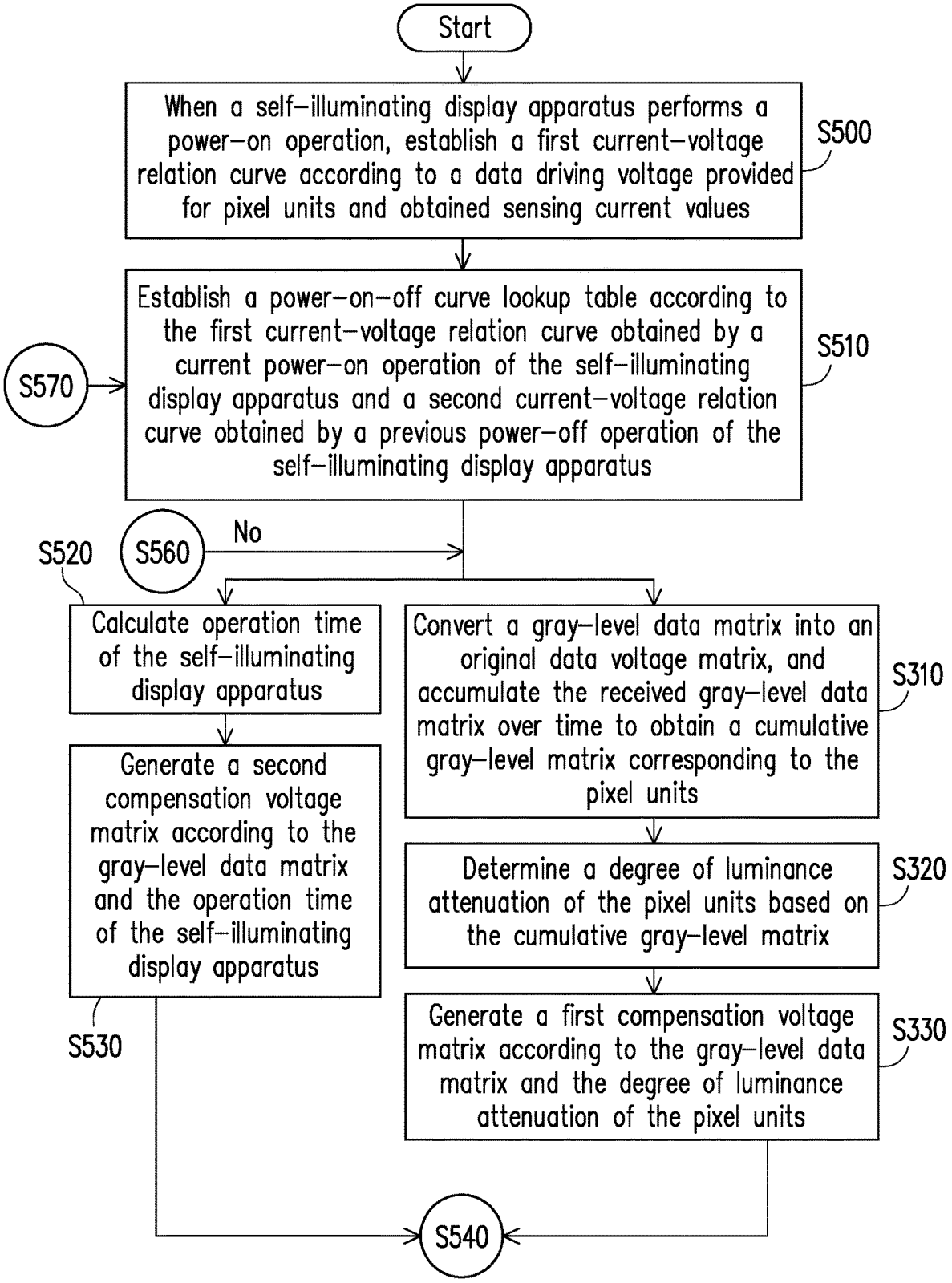
FIG. 5A to FIG. 5B show a flowchart showing the steps of a display frame compensation method in accordance with another embodiment of the disclosure.
Figure 5B:
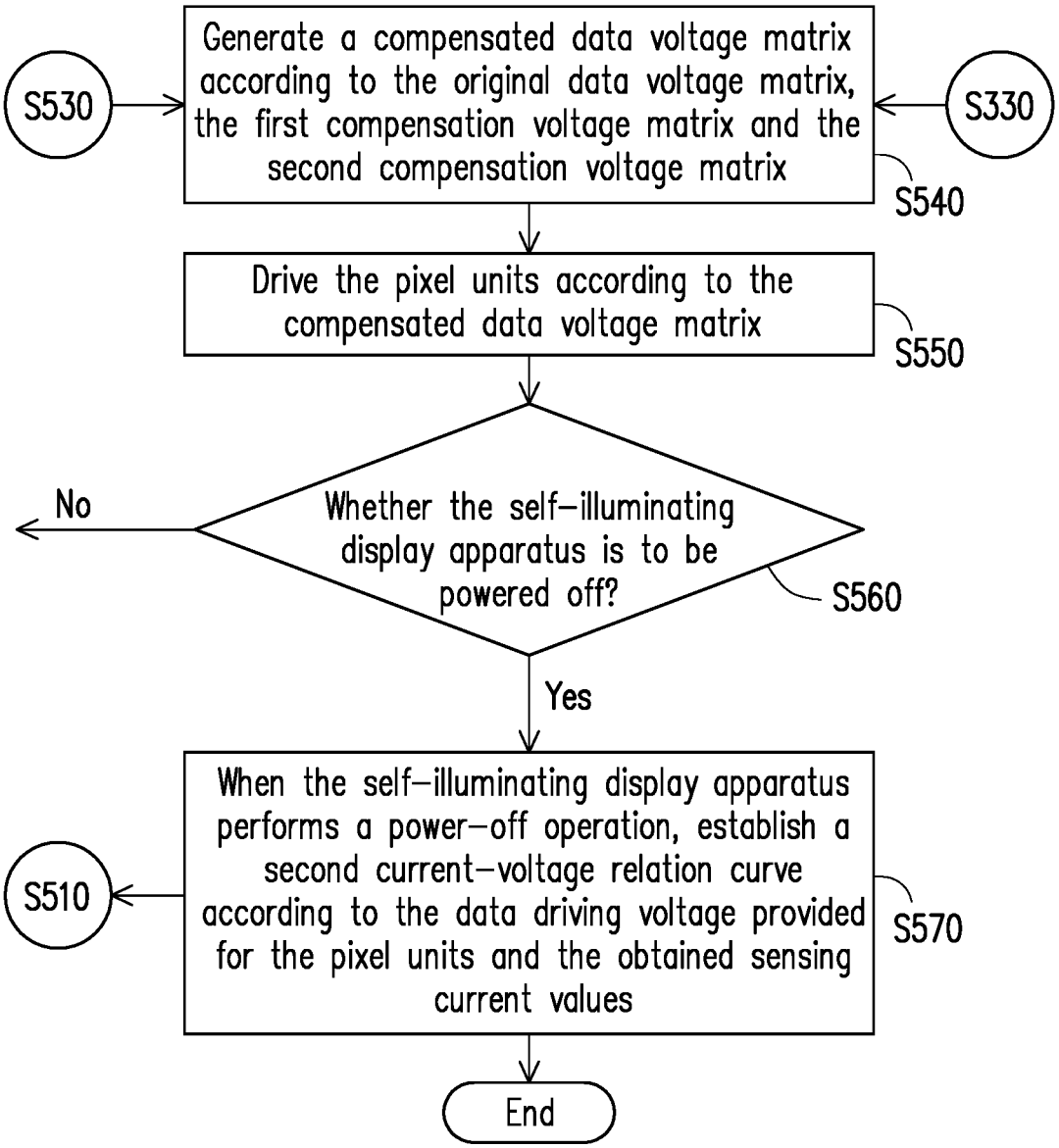

FIG. 5A to FIG. 5B show a flowchart showing the steps of a display frame compensation method in accordance with another embodiment of the disclosure. The method may be suitable for the self-illuminating display apparatus 100 of FIG. 1, but is not limited thereto. Referring to FIG. 1, FIG. 4A to FIG. 4C, and FIG. 5A to FIG. 5B together, the display frame compensation method of FIG. 5A to FIG. 5B includes the following steps. First, in step S500, when a self-illuminating display apparatus 100 performs a power-on operation, a compensation estimation circuit 160 establishes a first current-voltage relation curve TL_ON according to a data driving voltage provided for pixel units PX and obtained sensing current values SI. Next, in step S510, the compensation estimation circuit 160 establishes a power-on-off curve lookup table LUT2 according to the first current-voltage relation curve TL_ON obtained by a current power-on operation of the self-illuminating display apparatus 100 and a second current-voltage relation curve TL_OFF obtained by a previous power-off operation of the self-illuminating display apparatus 100. After step S510, steps S310, S320, and S330 may be performed then. Steps S310, S320, and S330 of FIG. 5A are similar to steps S310, S320, and S330 of FIG. 3, respectively. Therefore, the related description of FIG. 3 may be referred to, and the descriptions are omitted herein.

In addition, after step S510, steps S520 and S530 may also be performed. In detail, in step S520, the compensation estimation circuit 160 may calculate operation time of the self-illuminating display apparatus 100. Next, in step S530, the compensation estimation circuit 160 may generate a second compensation voltage matrix CDT according to a gray-level data matrix GLA and the operation time of the self-illuminating display apparatus 100. The second compensation voltage matrix CDT includes a plurality of second compensation voltages corresponding to the pixel units PX. In detail, the compensation estimation circuit 160 may find the second compensation voltages in the power-on-off curve lookup table LUT2 according to the gray-level data matrix GLA and the operation time of the self-illuminating display apparatus 100. Thereafter, in step S540, the compensation estimation circuit 160 may generate a compensated data voltage matrix CDA according to an original data voltage matrix ODA, a first compensation voltage matrix CDN and the second compensation voltage matrix CDT. Next, in step S550, a display driving circuit 140 drives the pixel units PX according to the compensated data voltage matrix CDA.

Thereafter, in step S560, the compensation estimation circuit 160 may determine whether the self-illuminating display apparatus 100 is to be powered off. If the determining result of step S560 is no, the process proceeds to steps S310 and S520 to perform a next display frame compensation operation. If the determining result of step S560 is yes, in step S570, when the self-illuminating display apparatus 100 performs a power-off operation, the compensation estimation circuit 160 establishes a second current-voltage relation curve TL_OFF according to the data driving voltage provided for the pixel units PX and the obtained sensing current values SI. The second current-voltage relation curve TL_OFF may be used to establish the power-on-off curve lookup table LUT2 when the self-illuminating display apparatus 100 is powered on next time.

In addition, other details of the display frame compensation method of the embodiment of FIG. 5A to FIG. 5B of the disclosure may be sufficiently illustrated, suggested, and implemented by the description of the embodiments of FIG. 1 to FIG. 4C, and therefore the descriptions thereof are omitted.

Based on the foregoing, in the self-illuminating display apparatus and the display frame compensation method thereof provided by the embodiments of the disclosure, the compensation estimation circuit may determine the degree of luminance attenuation of the pixel units based on the cumulative gray-level matrix, and accordingly provide the compensated data voltage matrix. The display driving circuit may drive the pixel units according to the compensated data voltage matrix, so that the pixel units display the correct luminance, thereby reducing the influence of the material characteristics of the pixel units on the display luminance of the pixel units. In addition, the compensation estimation circuit may also determine the degree of luminance attenuation of the pixel units according to the cumulative gray-level matrix and the operation time of the self-illuminating display apparatus, and accordingly provide the compensated data voltage matrix. In this way, not only the influence of the material characteristics of the pixel units on the display luminance of the pixel units can be reduced, but also the influence of temperature rise after long-term operation on the display luminance of the pixel units can be effectively reduced.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. A self-illuminating display apparatus, comprising:

a pixel array, comprising a plurality of pixel units arranged in an array;

a display driving circuit, coupled to the pixel array, and configured to receive a compensated data voltage matrix and drive the pixel units according to the compensated data voltage matrix; and a compensation estimation circuit, coupled to the display driving circuit, the compensation estimation circuit receiving a gray-level data matrix, and converting the gray-level data matrix into an original data voltage matrix, wherein the compensation estimation circuit accumulates the received gray-level data matrix over time to obtain a cumulative gray-level matrix corresponding to the pixel units, determines a degree of luminance attenuation of the pixel units based on the cumulative gray-level matrix, generates a first compensation voltage matrix according to the gray-level data matrix and the degree of luminance attenuation of the pixel units, and generates the compensated data voltage matrix according to the original data voltage matrix and the first compensation voltage matrix.

2. The self-illuminating display apparatus according to claim 1, wherein the compensation estimation circuit converts the cumulative gray-level matrix into a cumulative count matrix according to a conversion parameter, and determines a degree of luminance attenuation of the pixel units according to the cumulative count matrix, the conversion parameter being associated with material characteristics of the pixel units.

3. The self-illuminating display apparatus according to claim 2, wherein the first compensation voltage matrix comprises a plurality of first compensation voltages, and the compensation estimation circuit finds the first compensation voltages corresponding to the pixel units in a lookup table according to the gray-level data matrix and the cumulative count matrix respectively.

4. The self-illuminating display apparatus according to claim 1, wherein after the self-illuminating display apparatus is powered on, the compensation estimation circuit calculates operation time of the self-illuminating display apparatus, the compensation estimation circuit generates a second compensation voltage matrix according to the gray-level data matrix and the operation time, and the compensation estimation circuit generates the compensated data voltage matrix according to the original data voltage matrix, the first compensation voltage matrix and the second compensation voltage matrix.

5. The self-illuminating display apparatus according to claim 4, wherein the second compensation voltage matrix comprises a plurality of second compensation voltages, and the compensation estimation circuit finds the second compensation voltages corresponding to the pixel units in a power-on-off curve lookup table according to the gray-level data matrix and the operation time.

6. The self-illuminating display apparatus according to claim 5, further comprising:

a sensing circuit, coupled to the pixel array and the compensation estimation circuit, and configured to sense a current of each of the pixel units and accordingly generate a plurality of sensing current values corresponding to the pixel units respectively, wherein when the self-illuminating display apparatus performs a power-on operation, the compensation estimation circuit provides a data driving voltage through the display driving circuit to drive the pixel units, the compensation estimation circuit obtains the sensing current values during power-on through the sensing circuit, and the compensation estimation circuit establishes a first current-voltage relation curve according to the data driving voltage and the sensing current values during power-on;

wherein when the self-illuminating display apparatus performs a power-off operation, the compensation estimation circuit provides the data driving voltage through the display driving circuit to drive the pixel units, the compensation estimation circuit obtains the sensing current values during power-off through the sensing circuit, and the compensation estimation circuit establishes a second current-voltage relation curve according to the data driving voltage and the sensing current values during power-off; and wherein the compensation estimation circuit establishes the power-on-off curve lookup table according to the first current-voltage relation curve and the second current-voltage relation curve.

7. The self-illuminating display apparatus according to claim 6, wherein the compensation estimation circuit establishes the power-on-off curve lookup table according to the first current-voltage relation curve obtained by a current power-on operation and the second current-voltage relation curve obtained by a previous power-off operation.

8. A display frame compensation method for a self-illuminating display apparatus, the self-illuminating display apparatus comprising a plurality of pixel units arranged in an array, a display driving circuit, and a compensation estimation circuit, and the display frame compensation method comprising:

converting a gray-level data matrix into an original data voltage matrix, and accumulating the received gray-level data matrix over time to obtain a cumulative gray-level matrix corresponding to the pixel units by the compensation estimation circuit;

determining a degree of luminance attenuation of the pixel units by the compensation estimation circuit based on the cumulative gray-level matrix;

generating a first compensation voltage matrix according to the gray-level data matrix and the degree of luminance attenuation of the pixel units by the compensation estimation circuit;

generating a compensated data voltage matrix according to the original data voltage matrix and the first compensation voltage matrix by the compensation estimation circuit; and driving the pixel units according to the compensated data voltage matrix by the display driving circuit.

9. The display frame compensation method according to claim 8, wherein determining the degree of luminance attenuation of the pixel units based on the cumulative gray-level matrix comprises:

converting the cumulative gray-level matrix into a cumulative count matrix according to a conversion parameter, the conversion parameter being associated with material characteristics of the pixel units; and determining a degree of luminance attenuation of the pixel units according to the cumulative count matrix.

10. The display frame compensation method according to claim 9, wherein the first compensation voltage matrix comprises a plurality of first compensation voltages, and generating the first compensation voltage matrix according to the gray-level data matrix and the degree of luminance attenuation of the pixel units comprises:

finding the first compensation voltages corresponding to the pixel units in a lookup table according to the gray-level data matrix and the cumulative count matrix respectively.

11. The display frame compensation method according to claim 8, further comprising:

after the self-illuminating display apparatus is powered on, calculating operation time of the self-illuminating display apparatus by the compensation estimation circuit;

generating a second compensation voltage matrix according to the gray-level data matrix and the operation time by the compensation estimation circuit; and generating the compensated data voltage matrix according to the original data voltage matrix, the first compensation voltage matrix and the second compensation voltage matrix by the compensation estimation circuit.

12. The display frame compensation method according to claim 11, wherein the second compensation voltage matrix comprises a plurality of second compensation voltages, and generating the second compensation voltage matrix according to the gray-level data matrix and the operation time comprises:

finding the second compensation voltages corresponding to the pixel units in a power-on-off curve lookup table according to the gray-level data matrix and the operation time.

13. The display frame compensation method according to claim 12, further comprising:

when the self-illuminating display apparatus performs a power-on operation, providing a data driving voltage by the display driving circuit to drive the pixel units, obtaining sensing current values during power-on by a sensing circuit, and establishing a first current-voltage relation curve according to the data driving voltage and the sensing current values during power-on by the compensation estimation circuit;

when the self-illuminating display apparatus performs a power-off operation, providing the data driving voltage by the display driving circuit to drive the pixel units, obtaining sensing current values during power-off by the sensing circuit, and establishing a second current-voltage relation curve according to the data driving voltage and the sensing current values during power-off by the compensation estimation circuit; and establishing the power-on-off curve lookup table according to the first current-voltage relation curve and the second current-voltage relation curve by the compensation estimation circuit.

14. The display frame compensation method according to claim 13, wherein establishing the power-on-off curve lookup table according to the first current-voltage relation curve and the second current-voltage relation curve comprises:

establishing the power-on-off curve lookup table according to the first current-voltage relation curve obtained by a current power-on operation and the second current-voltage relation curve obtained by a previous power-off operation.

* * * * *